US005102168A

United States Patent [19]

Gold

[11] Patent Number: 5,102,168

[45] Date of Patent: Apr. 7, 1992

[54] RETAIL COUPONING SYSTEM

[76] Inventor: Raymond Gold, 8 Firethorne Cir., Lafayette Hill, Pa. 19444

[21] Appl. No.: 617,504

[22] Filed: Nov. 23, 1990

Related U.S. Application Data

[63] Continuation-in-part of Ser. No. 530,915, May 30, 1990, abandoned.

[51] Int. Cl.[5] ..... B42D 15/00

[52] U.S. Cl. ..... 283/105; 283/51; 283/56; 283/101; 283/106; 283/901

[58] Field of Search ..... 283/51, 56, 72, 100, 283/101, 103, 106, 105, 901

[56] References Cited

U.S. PATENT DOCUMENTS

| | | | |
|---|---|---|---|
| 2,109,603 | 3/1938 | Worth | 283/103 |
| 3,334,806 | 8/1967 | Hiersteiner | 475/232 |
| 3,582,111 | 6/1971 | Siiter | 283/56 |
| 3,734,544 | 5/1973 | Fishkin et al. | 283/56 |
| 3,900,219 | 8/1975 | D'Amato et al. | 283/101 |
| 4,011,985 | 3/1977 | Simson | 229/68 R |
| 4,033,611 | 7/1977 | Johnsen | 283/101 |
| 4,195,864 | 4/1980 | Morton et al. | 283/56 |
| 4,307,900 | 12/1981 | Krautsack | 283/56 |
| 4,685,699 | 8/1987 | Hirasawa | 281/15.1 |
| 4,722,544 | 2/1988 | Pettit | 280/688 |
| 4,738,473 | 4/1988 | Meloni et al. | 283/903 |
| 4,778,153 | 10/1988 | Bachman et al. | 283/101 |
| 4,817,990 | 4/1989 | Krost | 283/101 |
| 4,868,027 | 9/1989 | Hunkeler et al. | 428/42 |

FOREIGN PATENT DOCUMENTS 2414765 8/1979 France .

OTHER PUBLICATIONS

Free Standing Insert, Nov. 1989 "Amore".
Washington Post, Nov. 7, 1974 "Sara Lee".
Washington Post, Sep. 21, 1972 "Irish Spring", (two pages).
"Showboat's" promotion (Expires Aug. 7, 1987).
Various "McDonald" promotions (various expiration dates) (two pages).
"Lipton/Campbell's" option document–Example of U.S. Pat. No. 4,817,990–Krost.

*Primary Examiner*—P. W. Echols
*Assistant Examiner*—David P. Bryant
*Attorney, Agent, or Firm*—Caesar, Rivise, Bernstein, Cohen & Pokotilow, Ltd.

[57] ABSTRACT

A couponing system by which a consumer selects one of two coupons, hidden from the consumer, by pulling one of two zipper pulls which shears, destroys and renders invalid the non-selected coupon, while keeping intact the selected coupon.

34 Claims, 5 Drawing Sheets

RETAIL COUPONING SYSTEM

RELATED APPLICATION

This application is a continuation-in-part of U.S. application Ser. No. 07/530,915 filed May 30, 1990, now abandoned.

TECHNICAL FIELD

The present invention relates, in general, to retail coupons and, in particular, to multiple value coupons of the so-called "option" or "self-destruct" type.

BACKGROUND OF THE INVENTION

Consumer packaged goods companies are always looking for effective ways to increase the market share of their brands. The "option" or "self-destruct" retail coupon is one such technique. The consumer is encouraged to purchase more product or convert from a competitor's product. The "option" or "self-destruct" retail coupon is arranged with multiple coupons, one of which is to be selected by the consumer. When the selection is made, the selected coupon remains intact as a coupon and can be redeemed at the store, while the non-selected coupon is destroyed and the non-selected coupon is rendered invalid, thereby negating double redemption. A coupon is rendered invalid when it lacks the legal terms and conditions covering the consumer redemption conditions and retailer reimbursement text.

Various designs for option or self-destruct coupons have been suggested or put into actual use. Generally, they have not been adequately satisfactory in accomplishing their intended purpose. The manner in which the option or self-destruct coupon is to be used might not be clearly understood by the consumers. The arrangement of the coupons can confuse the consumer. The invalidation of the non-selected coupon might be appearance of a valid coupon. Besides consumer confusion if the multiple coupon is not understood and the desired coupon is not removed correctly, there can be even more confusion at the check-out counter of the store where the consumer is seeking redemption of the coupon.

SUMMARY OF THE INVENTION

A couponing system, according to the present invention, has first and second sections removably attached to each other along their edges to hide from view text on the inside surface of the first section. The first section has first and second coupons on its inside surface and means for tearing the first section along first and second lines. The first line extends through the first coupon and is displaced from the second coupon and the second line extends through the second coupon and is displaced from the first coupon.

DETAILED DESCRIPTION OF THE INVENTION

Figure 1:
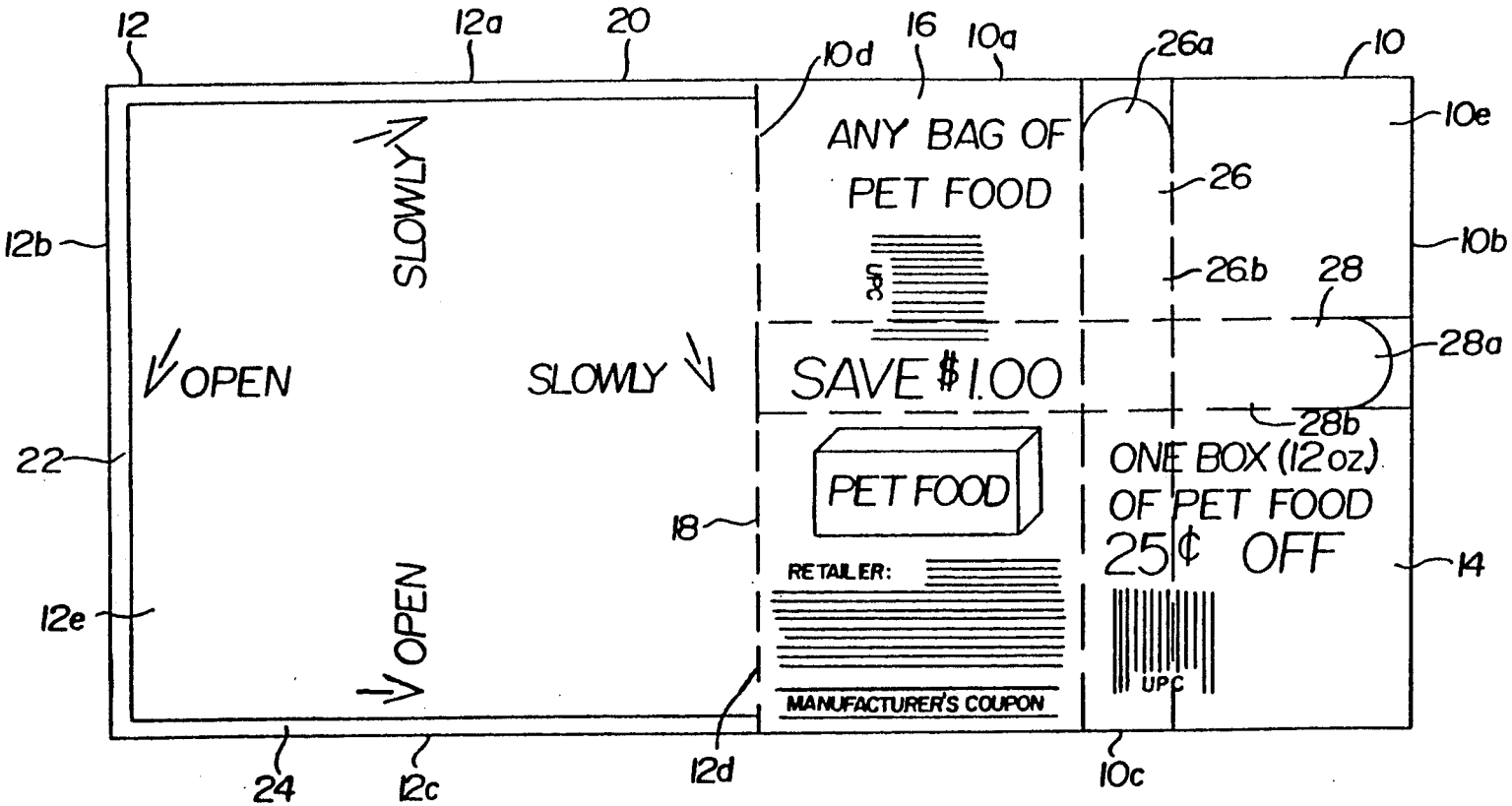
FIG. 1 is a plan view of a first preferred embodiment of a couponing system constructed in accordance with the present invention prior to its formation into a product as it is actually used.
Figure 2:
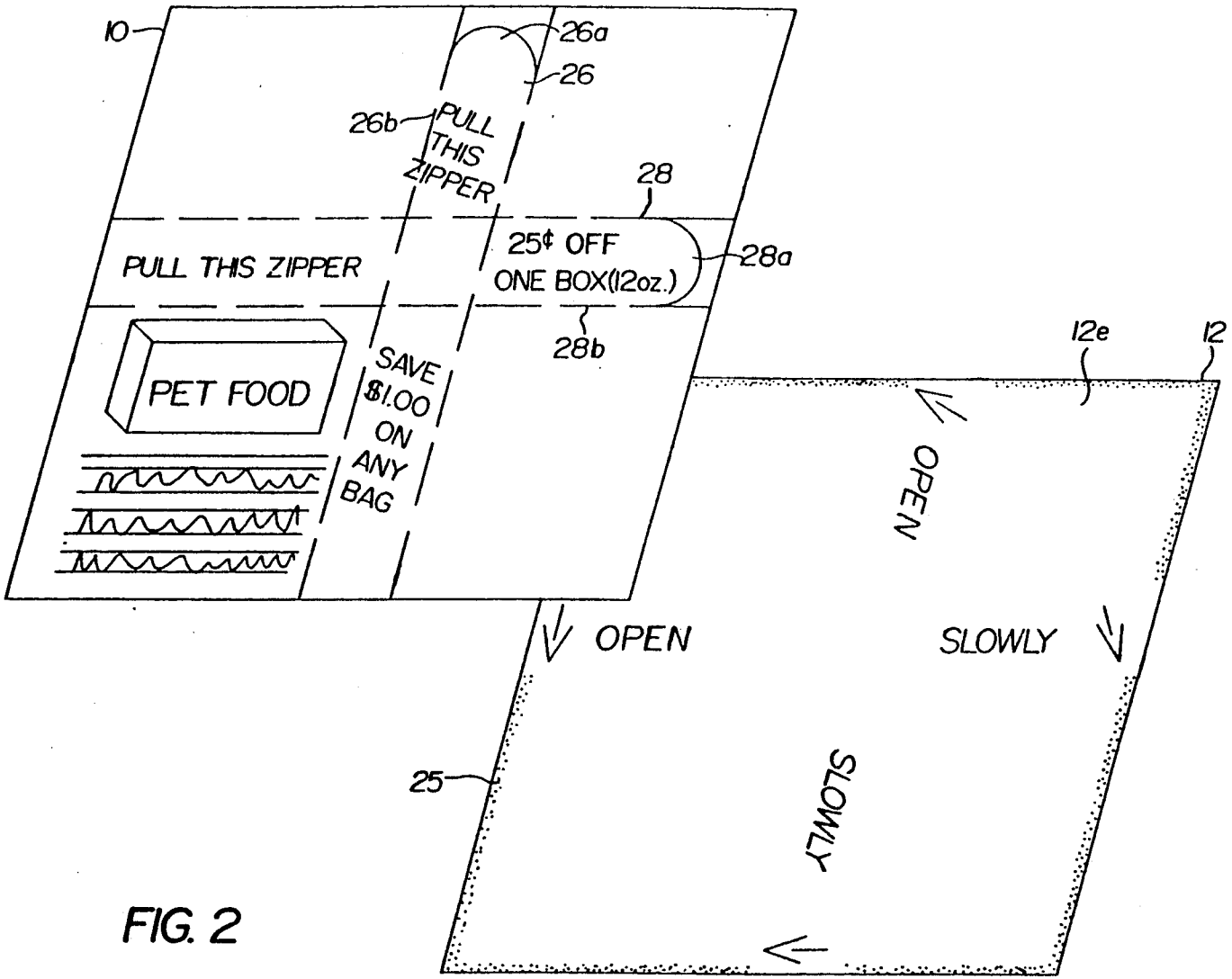
FIG. 2 is an exploded, perspective view of a second preferred embodiment of a couponing system constructed in accordance with the present invention prior to its formation into a product as it is actually used.
Figure 3:
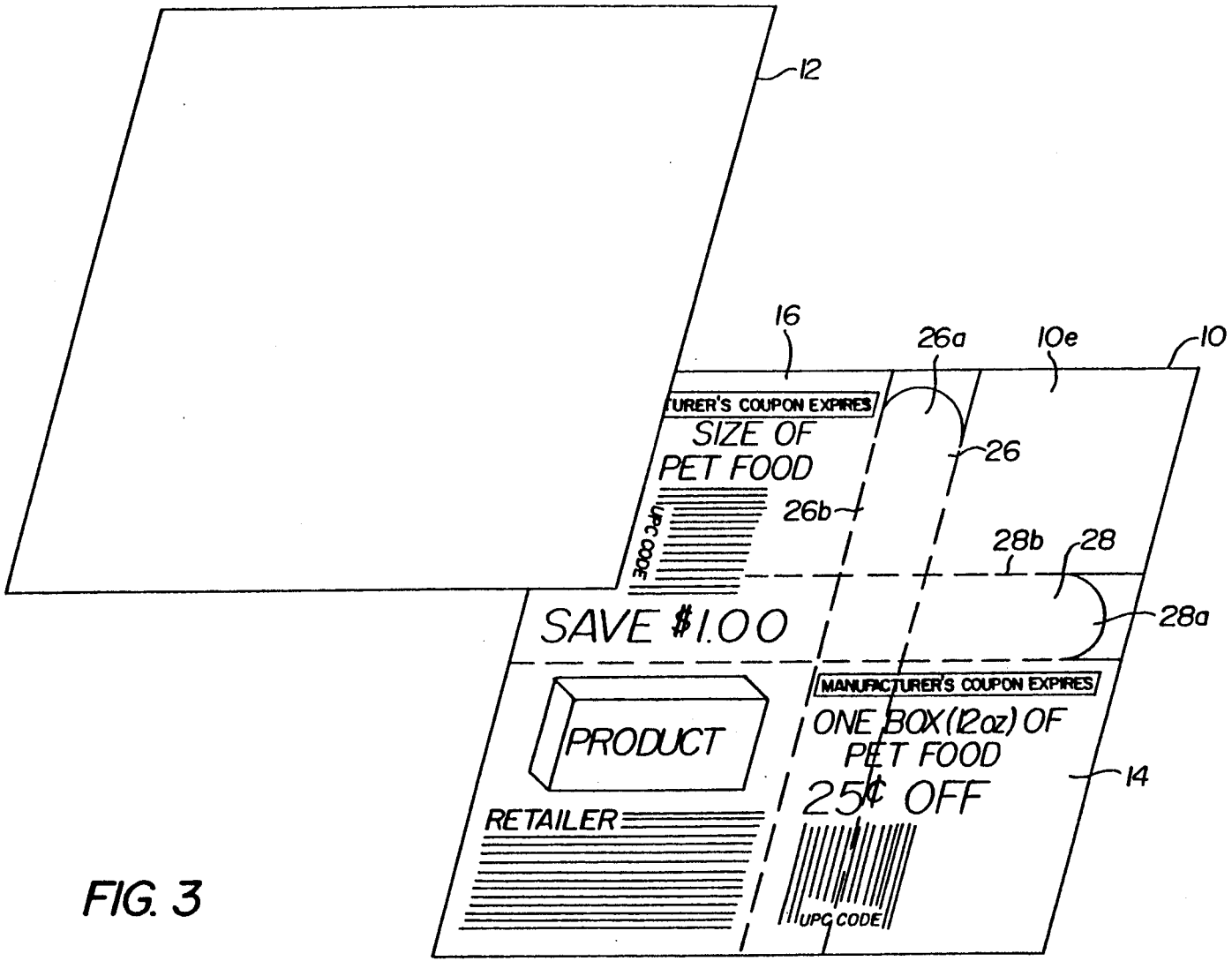
FIG. 3 is an exploded, perspective view of the FIG. 2 couponing system but from an opposite direction.

Referring to FIGS. 1, 2 and 3, a couponing system, constructed in accordance with the present invention, includes first and second sections 10 and 12, respectively, attached to each other along their edges 10*a* and 12*a*, 10*b* and 12*b*, 10*c* and 12*c*, and 10*d* and 12*d*. The attachment of sections 10 and 12 is such that text on either of the inside surfaces 10*e* and 12*e* of sections and 12, respectively, which face each other are hidden from view.

Section 10 has first and second coupons 14 and 16, respectively, with the text of the coupons on inside surface 10*e* of section 10. For the embodiment of the invention illustrated in FIGS. 1, 2 and 3, each of the coupons 14 and 16 extends along an edge of section 10. In particular, section 10 is shown as being rectilinear with coupon 14 extending along edge 10*c*, while coupon 16, disposed perpendicular to coupon 14, extends along edge 10*d* which adjoins edge 10*c*. With this arrangement, coupons 14 and 16 have a common portion in the corner of the adjoining edges which contains the required redemption text.

Section 12 is removably attached to section 10 to permit separation of portions of section 10 from section 12. For the embodiment of the invention illustrated in FIG. 1, sections 10 and 12 are attached along a perforated line 18 along which coupon 16 extends and by adhesive strips 20, 22 and 24 extending along the remaining edges of sections 10 and 12. For the embodiment of the invention illustrated in FIGS. 2 and 3, a fourth adhesive strip 25 is substituted for perforated line 18, so that sections 10 and 12 are removably attached by adhesive strips extending around their entire peripheries, except at selected locations which will be explained below. Instead of using adhesive strips, sections 10 and 12 can be attached by adhesive spots.

A couponing system, constructed in accordance with the present invention, also includes means for tearing section 10 along first and second lines, the first line extending through coupon 14 and displaced from coupon 16 and the second line extending through coupon 16 and displaced from coupon 14. For the embodiment of the invention illustrated in FIGS. 1, 2 and 3, the tearing means are in the form of first and second zipper pulls 26 and 28, respectively, on which the value portions of the coupons are located (i.e. "25" on zipper pull 26 and "$1.00" on zipper pull 28). Zipper pulls 26 and 28 are disposed perpendicular to each other and extend between the mid-points of opposite edges of section 10. A zipper pull is a perforated portion of a body of paper which can be separated from the body of paper along the perforations. Each of the zipper pulls 26 and 28 has a zipper pull tab end 26*a* and 28*a*, respectively, and a zipper run 26*b* and 28*b*, respectively. When pulled at their respective pull tab ends, at which locations there is no adhesive, the zipper pulls separate from section 10 along their respective runs. To facilitate tearing, the perforated lines which define zipper pulls 26 and 28 are cut along selected lengths at their points of intersection. In addition, perforated line 18, by which sections 10 and 12 are attached, is cut between the perforated lines which define zipper pull run 28b to facilitate complete removal of zipper pull 28 when it is pulled.

The couponing system of the present invention is intended to give a consumer the choice of selecting one of the coupons 14 and 16 which are contained on section 10 but which are concealed from the consumer prior to selection by the consumer. Once the selection is made, the selected coupon remains intact and can be presented for redemption, while the non-selected coupon is destroyed and rendered invalid, thereby preventing double-redemption. Thus, the selection process in using the couponing system of the present invention involves simultaneously making possible the removal of the non-selected coupon.

Coupon selection is made by pulling either zipper pull 26 or zipper pull 28. The zipper pulls are so disposed, relative to coupons 14 and 16, that when zipper pull 26 is pulled, coupon 14 is torn and destroyed and rendered invalid as the value portion (i.e. "25") is taken away from the remainder of the coupon, while coupon 16 remains intact and when zipper pull 28 is pulled, coupon 16 is torn and destroyed and rendered invalid as the value portion (i.e. "$1.00") is taken away from the remainder of the coupon, while coupon 14 remains intact. By carrying away the value portion of the non-selected coupon, the chances of improperly redeeming the non-selected coupon are reduced greatly, if not eliminated entirely, because the non-selected coupon is truly invalidated by obviously lacking the redemption value.

When one or the other of the zipper pulls is pulled, text on inside surface 12e of section 12 is exposed and revealed to the user, instructing the user how to remove the selected coupon. This is done by gently pulling the selected coupon away from section 12. Text which instructs the user on how to remove the selected coupon need not be presented on the inside surface of section 12 but instead can be presented on the exposed, outside surface of section 10 along with instructions on which zipper pull is associated with each coupon, or can be presented on the inside surface of section 10 which bears the coupons.

For the embodiment of the invention illustrated in FIG. 1, when coupon 14 is chosen, the adhesive bond along edges 10b and 12b and the adhesive bond along edges 10c and 12c are broken and perforated line 18 is torn along one half its length and when coupon 16 is selected, the adhesive bond along edges 10a and 12a and the adhesive bond along edges 10c and 12c are broken and perforated line 18 is torn along its entire length. For the embodiment of the invention illustrated in FIGS. 2 and 3, the adhesive bond along the strip substituted for perforated line 18 is broken, along with the other adhesive bonds, as the chosen coupon is separated from section 12. The nature of the adhesive selected for the couponing system is such that it serves as a bond in attaching sections 10 and 12 together and withstands the tendency of sections 10 and 12 to separate as one of the zipper pulls is pulled, but the adhesive bond is easily broken as a selected portion of section 10 is gently pulled away from section 12. Any of a variety of fugitive adhesives may be used as the adhesive.

The embodiments of the present invention illustrated in FIGS. 1, 2 and 3 indicate the applicability of the present invention to an option or self-destruct coupon of the type which reveals the values of the coupons on the outside surface of the couponing system but which hides the text of the coupons themselves from the consumer until coupon selection is made. The overall physical arrangement and the layout of the couponing system text, including hiding of the coupons themselves, reduces, if not eliminates, customer confusion. Instead of having to discern the individual boundaries of overlapping coupons, which is the common arrangement, the consumer needs only to pull one zipper pull or the other consistent with his or her selection and a coupon is selected from the hidden, overlapping coupons.

Figure 4:
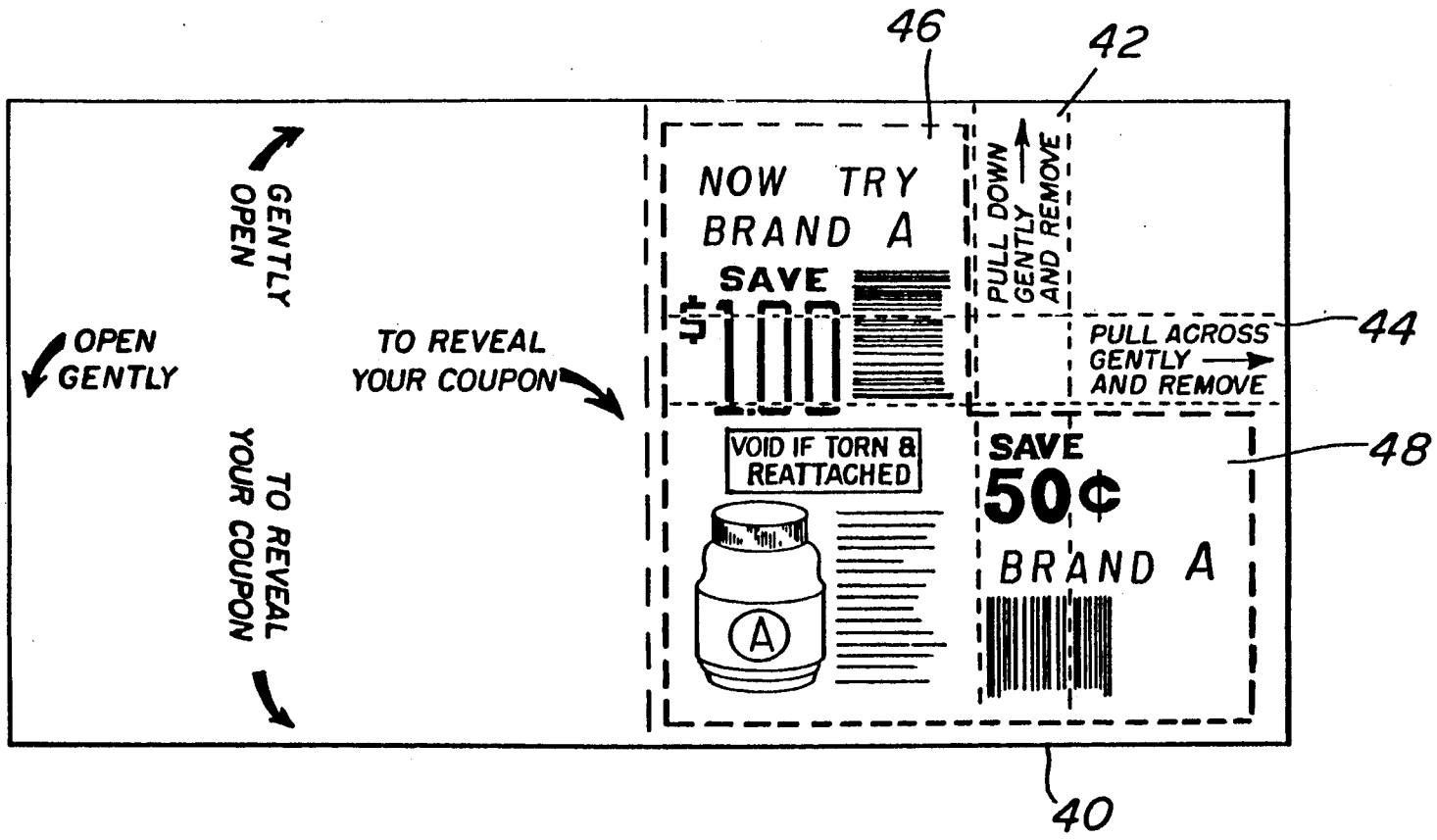
FIG. 4 is a plan view of a third preferred embodiment of a couponing system constructed in accordance with the present invention prior to its
Figure 5:
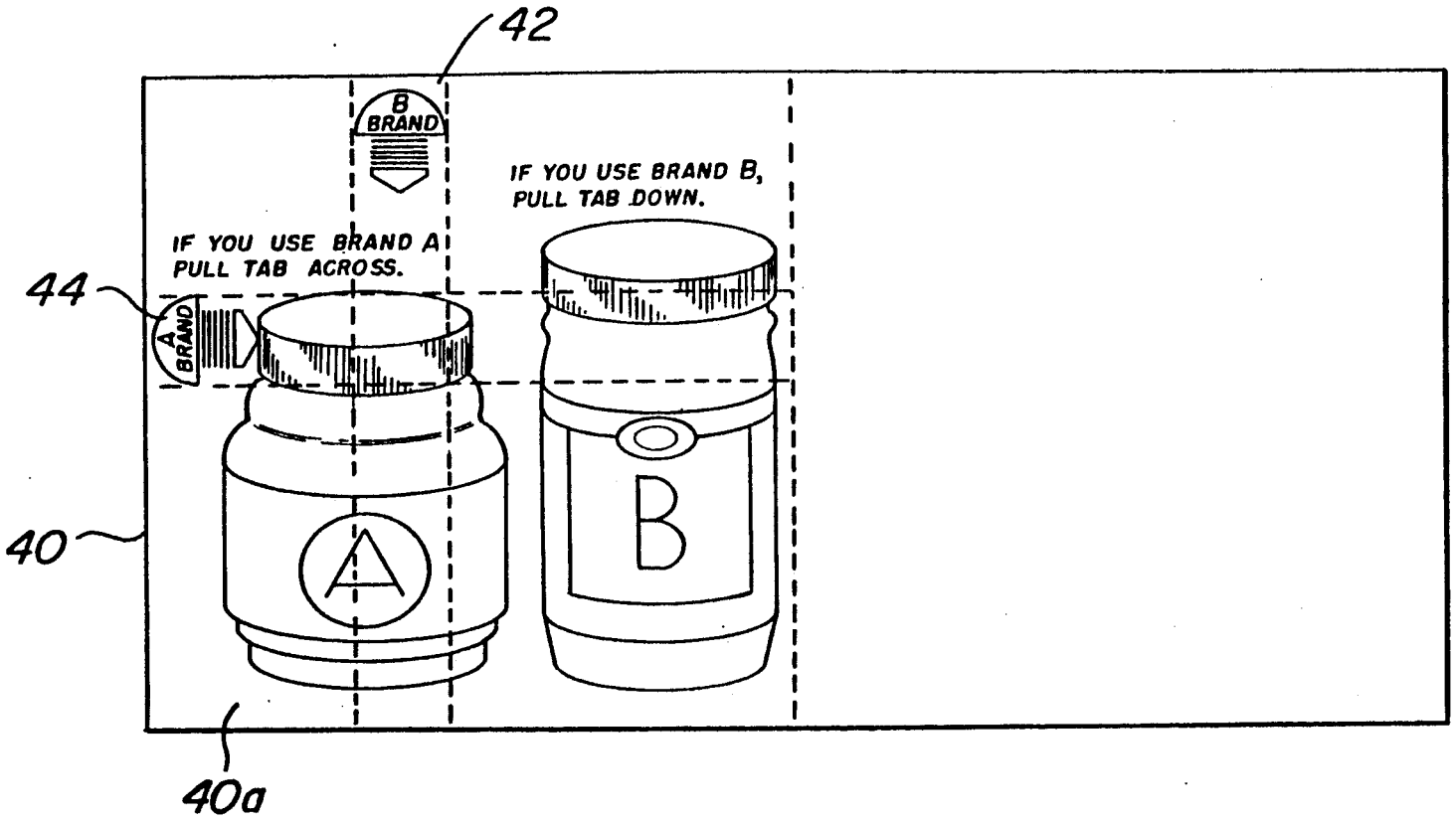
FIG. 5 is a plan view of the reverse side of the FIG. 4 couponing system.

The present invention also is applicable to option or self-destruct coupons of the type which hide the values of the coupons. FIGS. 4 and 5 illustrate the application of the present invention to such a couponing system. A consumer selects between two brands, illustrated on the outside surface 40a of a section 40, by pulling one of two zipper pulls 42 and 44. In doing so, one of two coupons 46 or 48, on the opposite, inside surface of section 40, is selected as with the FIGS. 1, 2 and 3 embodiment of the invention. Again, the coupons are hidden from the consumer, so that the coupon arrangement will not cause the consumer to become confused about the selection process itself. In contrast with the FIGS. 1, 2 and 3 embodiments, in the embodiment of FIGS. 4 and 5, the values of the coupons also are hidden from the consumer until the selection process is completed.

In the embodiment of the invention illustrated in FIG. 5, the value portions of the coupons (i.e. "50¢" and "$1.00") extend beyond the bounds of zipper pulls 42 and 44. As a result, the zipper pulls, extending along lines which extend through coupons 46 and 48, carry away only parts of the value portions of the coupons as one coupon is being selected and the other is being torn, destroyed and invalidated. Besides reducing the chances for improper redemption of an invalid coupon, as with the embodiments of the invention illustrated in FIGS. 1, 2 and 3, the FIG. 5 embodiment makes it more difficult for the user to determine the value of the invalid, non-selected coupon which, under certain Although the preferred embodiments of the invention have been illustrated as having square shapes, other configurations, such as a rectangle, can be employed.

While in the foregoing there have been described preferred embodiments of the present invention, it should be obvious to those skilled in the art that various modifications and changes can be made without departing from the true spirit and scope of the invention.

What is claimed is:

1. A couponing system having first and second sections removably attached to each other along their edges to hide from view text on the inside surface of said first section, said first section having first and second coupons with text of said coupons on the inside surface of said first section and means for tearing said first section along first and second lines, said first line extending through said first coupon and displaced from said second coupon and said second line extending through said second coupon and displaced from said first coupon.

2. A couponing system according to claim 1 wherein each of said first and said second coupons extends along an edge of said first section and said first line terminates at the edge of said first section along which said first coupon extends and said second line terminates at the edge of said first section along which said second coupon extends.

3. A couponing system according to claim 2 wherein said first and said second coupons extend perpendicular to each other and said first and said second lines extend perpendicular to each other.

4. A couponing system according to claim 2 wherein said first and said second sections are rectilinear.

5. A couponing system according to claim 4 wherein:

(a) said first and said second sections are identical squares, (b) said first and said second coupons extend perpendicular to each other along adjoining edges of said first section, and (c) said first and said second lines extend perpendicular to each other between the mid-points of opposite edges of said first section.

6. A couponing system according to claim 5 wherein said tearing means include a first zipper pull extending along said first line and a second zipper pull extending along said second line.

7. A couponing system according to claim 6 wherein the perforated lines which define said first and said second zipper pulls are cut along selected lengths at their points of intersection.

8. A couponing system according to claim 6 wherein said first and said second sections are attached to each other by a perforated line along which one of said coupons extends and by adhesive strips extending along the remaining three edges of at least one of said first and said second sections.

9. A couponing system according to claim 8 wherein said perforated line by which said first and said second sections are attached is cut between said perforated lines defining that zipper pull terminating at said perforated line by which said first and said second sections are attached.

10. A couponing system according to claim 8 wherein said second section contains text on its inside surface facing said inside surface of said first section which is revealed to a user when either of said zipper pulls is pulled to expose said text.

11. A couponing system according to claim 6 wherein said first and said second sections are attached to each other by adhesive strips extending along the four edges of at least one of said first and said second sections.

12. A couponing system according to claim 11 wherein said second section contains text on its inside surface facing said inside surface of said first section which is revealed to a user when either of said zipper pulls is pulled to expose said text.

13. A couponing system according to claim 1 wherein each of said coupons has a value portion and said first line extends through the value portion of said first coupon and said second line extends through the value portion of said second coupon.

14. A couponing system according to claim 13 wherein said tearing means includes a first zipper pull extending along said first line through said value portion of said first coupon and a second zipper pull extending along said second line through said value portion of said second coupon.

15. A couponing system according to claim 14 wherein said first zipper pull contains the entire value portion of said first coupon and said second zipper pull contains the entire value portion of said second coupon.

16. A couponing system according to claim 14 wherein a part of said value portion of said first coupon extends beyond the bounds of said first zipper pull and a part of said value portion of said second coupon extends beyond the bounds of said second zipper pull 17. A couponing system according to claim 14 wherein the values of said coupons are indicated on the outside surface of said first section.

18. A couponing system according to claim 14 wherein the only indication of the values of said coupons is said value portions of said coupons.

19. A couponing system comprising:

a first section having:

(a) first and second coupons, and (b) first and second zipper pulls extending through said first and second coupons, respectively, and so disposed that when:

(i) said first zipper pull is pulled through said first coupon, said first coupon is torn, destroyed and rendered invalid and said second coupon remains intact, and (ii) said second zipper pull is pulled through said second coupon, said second coupon is torn, destroyed and rendered invalid and said first coupon remains intact;

and a second section overlying said first section to cover the text of said first and said second coupons and removably attached to said first section to permit separation of portions of said first section from said second section after one of said first and said second zipper pulls has been pulled through its associated coupon.

20. A couponing system according to claim 19 wherein each of said first and said second coupon extends along an edge of said first section and each of said first and said second zipper pulls terminates at the edge of said first section along which its associated coupon extends.

21. A couponing system according to claim 20 wherein said first and said sections are rectilinear.

22. A couponing system according to claim 19 wherein said first and said second coupons extend perpendicular to each other and said first and said second zipper pulls extend perpendicular to each other.

23. A couponing system according to claim 22 wherein:

(a) said first and said second sections are identical squares, (b) said first and said second coupons extend perpendicular to each other along adjoining edges of said first section, and (c) said first and said second zipper pulls extend perpendicular to each other between the mid-points of opposite edges of said first section.

24. A couponing system according to claim 23 wherein the perforated lines which define said first and said second zipper pulls are cut along selected lengths at their points of intersection.

25. A couponing system according to claim 24 wherein said second section is attached to said first section by a perforated line along which one of said coupons extends and by adhesive strips extending along the remaining three edges of at least one of said first and said second sections.

26. A couponing system according to claim 25 wherein said second section contains text revealed to a user when either of said zipper pulls is pulled to expose said text.

27. A couponing system according to claim 24 wherein said perforated line by which said first and said second sections are attached is cut between said perforated lines defining that zipper pull terminating at said perforated line by which said first and said second sections are attached.

28. A couponing system according to claim 24 wherein said first and said second sections are attached to each other by adhesive strips extending along the four edges of at least one of said first and said second sections.

29. A couponing system according to claim 28 wherein said second section contains text revealed to a user when either of said zipper pulls is pulled to expose said text.

30. A couponing system according to claim 19 wherein said first coupon has a value portion through which said first zipper pull extends and said second coupon has a value portion through which said second zipper pull extends.

31. A couponing system having first and second coupons on the same surface of a sheet of paper with each of said coupons having a value portion, a first zipper pull extending through said value portion of said first coupon and displaced from said second coupon, and a second zipper pull extending through said value portion of said second coupon and displaced from said first coupon.

32. A couponing system according to claim 31 wherein said first zipper pull contains the entire value portion of said first coupon and said second zipper pull contains the entire value portion of said second coupon.

33. A couponing system according to claim 31 wherein a part of said value portion of said first coupon extends beyond the bounds of said first zipper pull and a part of said value portion of said second coupon extends beyond the bounds of said second zipper pull.

34. A couponing system comprising:

first and second coupons on the same surface of a sheet of paper with each of said coupons having a value portion; and first and second zipper pulls extending through said value portions of said first and said second coupons, respectively, said zipper pulls so disposed that when:

(a) said first zipper pull is pulled through said first coupon, said value portion of said first coupon is separated from said first coupon and said first coupon is destroyed and rendered invalid and said second coupon remains intact, and (b) said second zipper pull is pulled through said second coupon, said value portion of said second coupon is separated from said second coupon and said second coupon is destroyed and rendered invalid and said first coupon remains intact.

* * * * *